United States Patent [19]

Yoshida et al.

[11] Patent Number: 4,551,946

[45] Date of Patent: Nov. 12, 1985

[54] DOOR SWINGING DEVICE FOR AUTOMATICALLY SWINGING DOORS

[75] Inventors: Kei Yoshida; Yoichiro Saotome, both of Tokyo, Japan

[73] Assignee: Chikura Kogyo Kabushiki Kaisha, Japan

[21] Appl. No.: 570,759

[22] Filed: Jan. 16, 1984

[30] Foreign Application Priority Data

Feb. 8, 1983 [JP] Japan ..... 58-16959[U]

[51] Int. Cl.[4] ..... E05F 11/24

[52] U.S. Cl. ..... 49/340; 49/345; 49/346

[58] Field of Search ..... 49/339–341, 49/345, 346

[56] References Cited

U.S. PATENT DOCUMENTS 1,335,429 3/1920 Danielson ..... 49/346
1,865,925 7/1932 Kunde .
2,961,234 11/1960 Munro ..... 49/346
3,878,646 4/1975 Crocker ..... 49/346 X

FOREIGN PATENT DOCUMENTS 2527843 1/1977 Fed. Rep. of Germany ..... 49/346

*Primary Examiner*—Kenneth Downey
*Attorney, Agent, or Firm*—Darby & Darby

[57] ABSTRACT

A door swinging device for automatically swinging a door hinged to a door supporting frame so as to be angularly movable about a vertical axis. The door swinging device includes: (a) a mechanism for rotating; (b) an arm member adapted to be attached at one end thereof to the rotating mechanism so as to be rotated in a plane; (c) a slider rotatably connected to the other end of the arm member; and (d) a guiding mechanism, adapted to be attached to one of the door and the door supporting frame, for guiding slidably the slider in a direction parallel with the plane.

3 Claims, 7 Drawing Figures

DOOR SWINGING DEVICE FOR AUTOMATICALLY SWINGING DOORS

BACKGROUND OF THE INVENTION

The present invention relates to a door swinging device for automatically opening and closing doors, and more particularly relates to a link mechanism of such door swinging device.

FIGS. 1 and 2 illustrate a typical example of the conventional door swinging device, in which 1 designates a door operator attached to a header of a door supporting frame 2 or a wall above the door supporting frame 2. The door operator 1 is provided with an electric motor (not shown). A rotating shaft 3 which is operatively connected to the electric motor projects downwards through the casing of the door operator 1. A rotating arm 4 is attached at its one end to the rotating shaft 3 so as to rotate in a horizontal plane, and is pivotably connected at the other end to one end of a connecting arm 5, the other end of which is pivotally connected to a bracket member 6 which is fixed to and projects from an upper portion of a door 7 hinged to a jamb of the door supporting frame 2 so as to be swingable about a vertical axis. The rotating arm 4, connecting arm 5 and bracket member 6 forms a door swinging link mechanism.

When the rotating shaft 3 is angularly moved in the direction A or clockwise in FIG. 2, the rotating arm 4 is turned in the same direction, which causes the door 7 to be swung and opened through the connecting arm 5 and the bracket member 6 to a position shown by the phantom line in FIG. 2. In this prior art door swinging device, it is necessary to project a rather large length of bracket 6 from the door 7 in order to effectively swing it. Thus, for example, when the door 7 is, as shown in FIG. 2, provided transversely of a passage way, the door 7 cannot be fully opened unless a recess 9 for receiving the bracket 6 and the connecting arm 5 is, as shown, formed in the side wall 8 since the bracket 6 abuts against the side wall 8. The side wall 8 is deteriorated in the strength and appearance by the presence of the recess 9.

SUMMARY OF THE INVENTION

Accordingly, it is an object of the present invention to provide a door swinging device for automatically swinging doors which fully opens the doors without providing any recess or the like to the adjacent wall, and which thereby improves the strength and appearance of the wall.

With these and other objects in view, the present invention provides a door swinging device for automatically swinging a door hinged to a door supporting frame so as to be angularly movable about a vertical axis. The door swinging device includes: (a) a mechanism for rotating; (b) an arm member adapted to be attached at one end thereof to the rotating mechanism so as to be rotated in a plane; (c) a slider rotatably connected to the other end of the arm member; and (d) a guiding mechanism, adapted to be attached to one of the door and the door supporting frame, for guiding slidably the slider in a direction parallel with the plane.

BRIEF DESCRIPTION OF THE DRAWINGS

While the specification concludes with claims which particularly point out and distinctly define the subject matter which is regarded as the invention, it is believed the invention will be more clearly understood from the following detailed description and the accompanying drawings, in which:

DETAILED DESCRIPTION OF THE PREFERRED EMBODIMENTS

Figure 1:
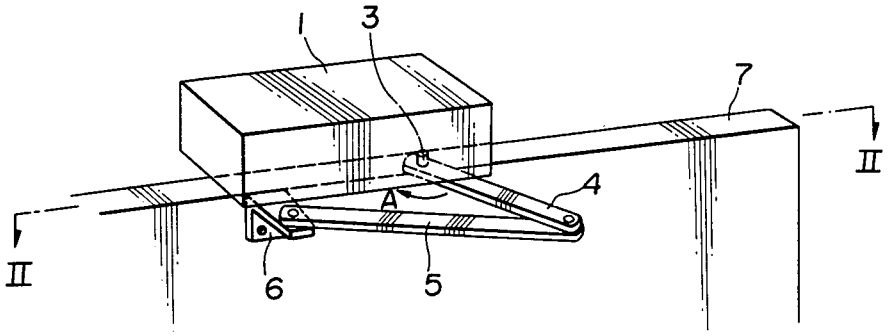
FIG. 1 (PRIOR ART)
FIG. 1 is a perspective view illustrating the conventional door swinging device.
Figure 2:
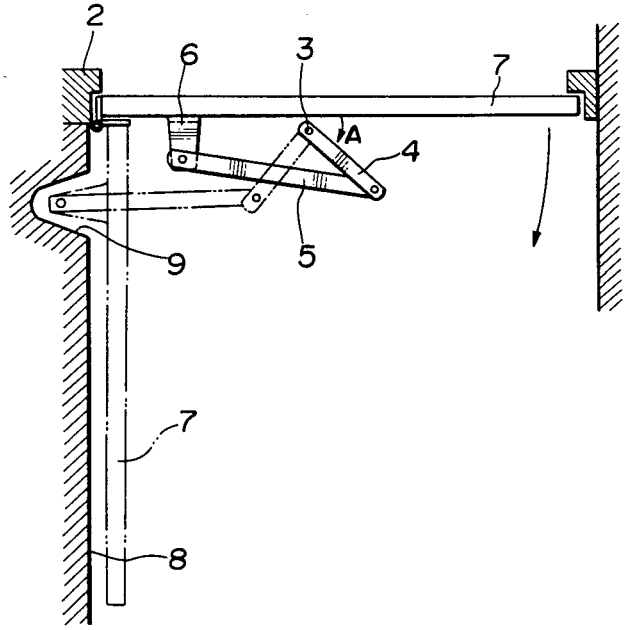
FIG. 2 (PRIOR ART)
FIG. 2 is a view taken along the line II—II in FIG. 1.
Figure 3:
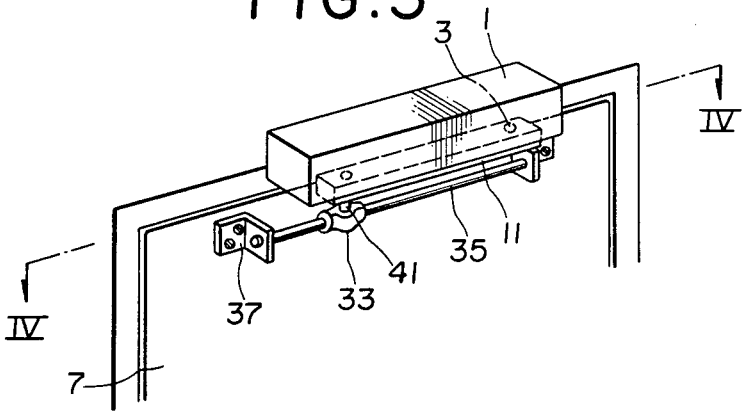
FIG. 3 is a perspective view illustrating a door swinging device according to the present invention.
Figure 4:
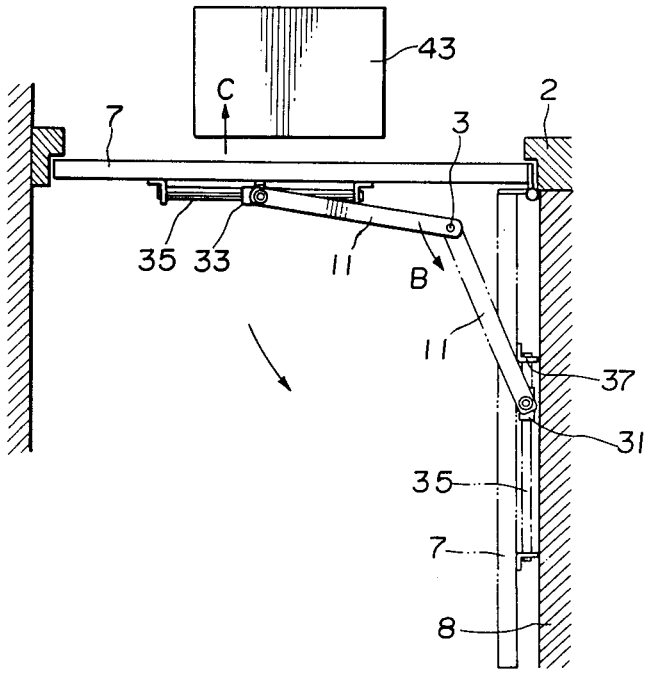
FIG. 4 is a view taken along the line IV—IV in FIG. 3.
Figure 5:
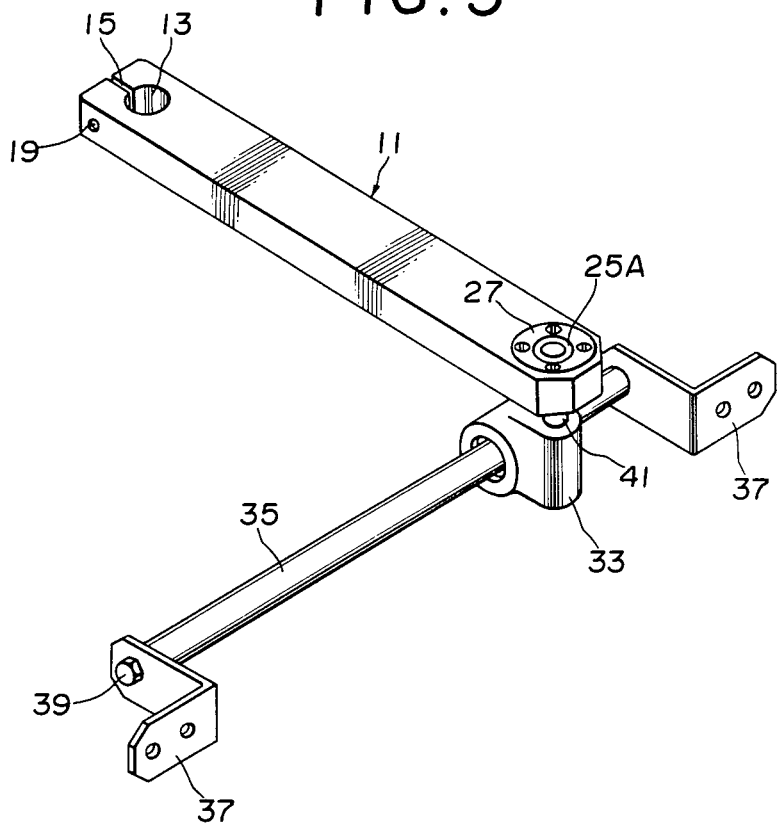
FIG. 5 is an enlarged perspective view of the door opening link mechanism in FIG. 4.
Figure 6:
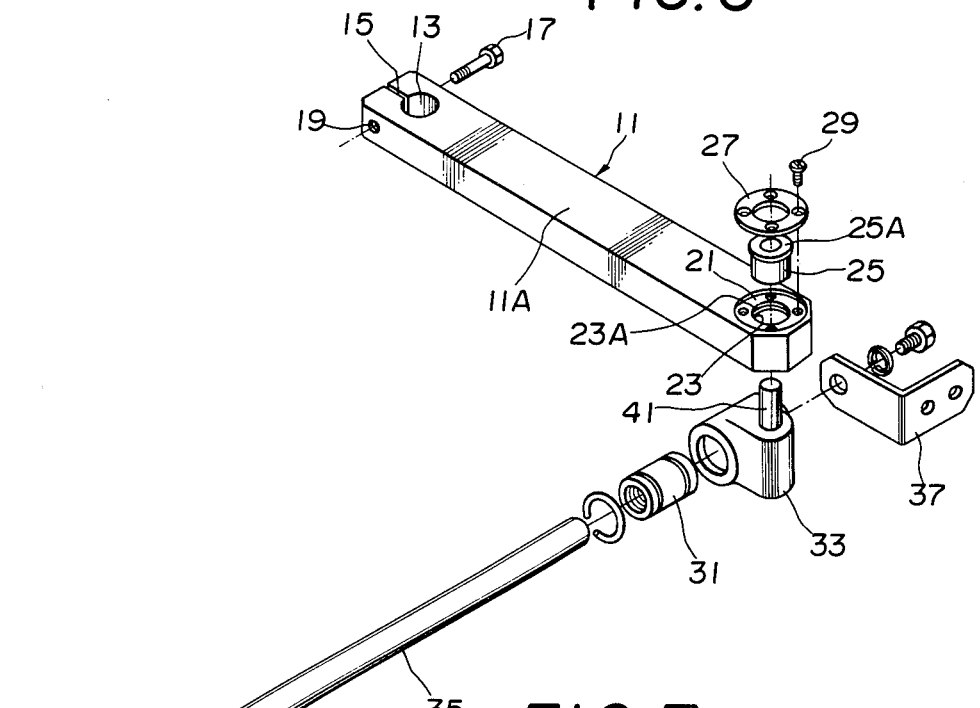
FIG. 6 is an exploded view of the link mechanism in FIG. 5.

Referring to FIGS. 3 and 4, there is illustrated one embodiment of the present invention, in which each member similar to the member used in the prior art door swinging device shown in FIG. 1 is designated by the same reference number, and the description thereof is omitted. An arm member 11 of a link mechanism is attached at its one end to the rotating shaft 3 of the door operator 1 so that it may be angularly movable in a horizontal plane. The link mechanism is more detailedly shown in FIGS. 5 and 6. The arm member 11 is provided at its proximal end portion with a cramping hole 13 which extends perpendicularly to the upper face 11A thereof. The hole 13 communicates with a slit 15 formed in the proximal end. The rotating shaft 3 is fitted into that clamping hole 13 and fastened there by a screw 17 which threadedly engages with a through hole 19 formed through the slitted end and clamps the latter. To the upper face 11A of the fee end of the arm member 11 there is provided a circular recess 21 through which a round supporting hole 23 is centrally formed so as to be in parallel with the clamping hole 13, the supporting hole having a circular shoulder 23A formed in the wall thereof. A ball bushing 25 which has a circular flange 25A formed radially outwardly around its upper end is inserted into the supporting hole 23 with its flange 25A tightly fitted into the shoulder 23A, and then coaxially fixed there by fitting and fastening a cramp ring 27 to the recess 21 with screws 29, the cramping ring covering the outer peripheral portion of the flange 25A as shown in FIG. 5.

The link mechanism further includes another ball bushing 31, as a slider, which is fixedly accommodated in a casing 33 having a shaft 41 projected from it perpendicularly to the axis of the bushing 31. The bushing 31 is slidably fitted around an elongated guide bar 35, of which the opposite ends are each fixed to a bracket 37 with a screw 39. The ball bushing 31 is connected to the arm member 11 by fitting the shaft 41 of the casing 33 into the ball bushing 25 so as to be vertically slidably and rotably about the axis thereof. The brackets 37 are, as shown in FIG. 3, screwed to an upper portion of the door 7 so that the guide bar 35 extends horizontally. The vertical position of the brackets 37 may be adjusted by sliding the shaft 41 of the casing 33 relative to the bushing 25.

In operation, when a mat switch 43 (FIG. 4) placed in front of the door 7 and connected through a cable to a power source (not shown) is activated, the electric motor of the door operator 1 is energized, causing the rotating shaft 3 to turn in the direction of the arrow B, so that the rotating arm 11 is rotated to a position shown by the phantom line in FIG. 4. By this rotation of the arm 11 the ball bushing 31 slides on the guide bar 35 towards the hinged edge of the door 7, and the door is thereby opened to a position, adjacent to the side wall 8, shown by the phantom line in FIG. 4. During this opening of the door 7 the free end of the rotating arm 11 is kept at a predetermined distance from the door 7, and hence when the door 7 is fully opened, the brackets 37 or the bushing 31 brought into contact with the wall 8. The length of the brackets 37 projecting from the door 7 is much smaller than that of the bracket 6 of the prior art due to the difference in structure. Thus, the door operator according to the present invention is capable of fully opening the door without providing any recess for receiving the brackets 37 to the wall 8.

When the door 7 is hinged to the door supporting frame 2 so that it may be opened in a direction of the arrow C in FIG. 4, it is swung toward such direction by rotating the shaft 3 in a direction reverse to the arrow B. Thus, it is clear that the door swinging device according to the present invention can also perform the "push open" operation.

Figure 7:
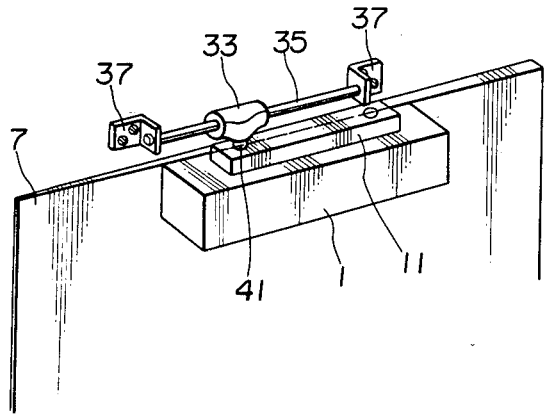
FIG. 7 is a perspective view illustrating another mode of the mounting of the door swinging device in FIG. 3.

FIG. 7 shows another mode of the mounting of the door swinging device shown in FIG. 3, in which the door operator 1 is mounted on an upper portion of the door 7 and the brackets 37 are fastened to the header of the door supporting frame.

What is claimed is:

1. A door swinging device for automatically swinging a door hinged to a door supporting frame so as to be angularly movable about a vertical axis, comprising:

means for rotating;

an arm member adapted to be attached at one end thereof to the rotating means so as to be rotated in a plane;

a slider rotatably connected to the other end of the arm member; and means, adapted to be attached to one of the door and the door supporting frame, for guiding slidably the slider in a direction parallel with the plane, the guiding means including an elongated guide member and a pair of bracket members for supporting respective ends of the guide member on the one of the door and the door supporting frame so that the guide member extends in the direction parallel with the plane, the slider including a first sleeve member adapted to be slidably fitted around the elongated guide member, the slide being further provided with a connecting shaft extending perpendicularly to the axis of the first sleeve member, the arm member being provided at the other end with a second sleeve member for slidably and rotatably fitting the connecting shaft thereinto so that the connecting shaft is perpendicular to the plane, the arm member being provided at the other end with a recess and a through hole formed centrally through the recess, the through hole having a circumferential shoulder formed at one end thereof adjacent to the recess, the second sleeve member being provided at one end thereof with a flange radially outwardly projected from the one end, the flange being tightly fitted into the shoulder, the second sleeve member further including a clamping planar member fitted into and screwed to the recess for clamping the flange of the second sleeve member with the shoulder of the through hole.

2. A door swinging device as recited in claim 1, wherein the clamping planar member is provided with a second through hole for allowing the connecting shaft of the slider to pass through the planar member.

3. A door swinging device for automatically swinging a door hinged to a door supporting frame so as to be angularly movable about a vertical axis, comprising:

means for rotating;

an arm member adapted to be attached at one end thereof to the rotating means so as to be rotated in a plane;

a slider rotatably connected to the other end of the arm member; and means, adapted to be attached to one of the door and the door supporting frame, for guiding slidably the slider in a direction parallel with the plane, the guiding means including an elongated guide member and a pair of bracket members for supporting respective ends of the guide member on the one of the door and the door supporting frame so that the guide member extends in the direction parallel with the plane, the slider including a first sleeve member adapted to be slidably fitted around the elongated guide member, the slider being further provided with a connecting shaft extending perpendicularly to the axis of the first sleeve member, the arm member being provided at the other end with a second sleeve member for slidably and rotatably fitting the connecting shaft thereinto so that the connecting shaft is perpendicular to the plane.

* * * * *